US008062099B2

(12) United States Patent
Hachisuka

(10) Patent No.: US 8,062,099 B2
(45) Date of Patent: Nov. 22, 2011

(54) POWER TOOL

(75) Inventor: Tomohiro Hachisuka, Anjo (JP)

(73) Assignee: Makita Corporation, Anjo-shi (JP)

( * ) Notice: Subject to any disclaimer, the term of this patent is extended or adjusted under 35 U.S.C. 154(b) by 351 days.

(21) Appl. No.: 12/314,662

(22) Filed: Dec. 15, 2008

(65) Prior Publication Data

US 2009/0165610 A1 Jul. 2, 2009

(30) Foreign Application Priority Data

Dec. 26, 2007 (JP) ..... 2007-334989

(51) Int. Cl.
*B24B 23/00* (2006.01)

(52) U.S. Cl. ..... 451/359; 451/451

(58) Field of Classification Search ..... 451/359, 451/508, 509, 360, 358, 451, 454
See application file for complete search history.

(56) References Cited

U.S. PATENT DOCUMENTS

| | | | | |
|---|---|---|---|---|
| 5,813,805 | A * | 9/1998 | Kopras | 408/241 R |
| 5,902,080 | A * | 5/1999 | Kopras | 409/182 |
| 6,827,074 | B2 * | 12/2004 | Gardner | 125/25 |

FOREIGN PATENT DOCUMENTS

| | | | |
|---|---|---|---|
| CN | 2327505 | Y | 7/2009 |
| DE | 41 19 325 | A1 | 12/1992 |
| DE | 296 22 019 | U1 | 5/1998 |
| GB | 2 320 818 | A | 7/1998 |
| JP | U-5-41662 | | 6/1993 |

OTHER PUBLICATIONS

Office Action issued in Chinese Patent Application No. 200810178262.1, on Feb. 5, 2010 (with translation).
European Search Report for corresponding European Patent Application No. 08022147.6, mailed on Aug. 4, 2010.

* cited by examiner

*Primary Examiner* — Robert Rose
(74) *Attorney, Agent, or Firm* — Oliff & Berridge, PLC

(57) ABSTRACT

It is an object of the invention to provide an effective technique for improving the gripping characteristics in a hand-held power tool. To solve the problem, a representative power tool is provided to include a motor that drives a tool bit, a cylindrical housing that houses the motor, a motor actuating parts that actuates the motor, a cylindrical cover that is connected to one end of the housing in its longitudinal direction and houses the motor actuating parts. A grip to be held by a user of the power tool is defined by the housing and the cylindrical cover. A plurality of projections are formed on the outer surface of the grip in a circumferential direction of the grip and that each projection extends between the housing and the cover in the longitudinal direction of the power tool.

8 Claims, 3 Drawing Sheets

POWER TOOL

BACKGROUND OF THE INVENTION

1. Field of the Invention

The present invention relates to a hand-held power tool.

2. Description of the Related Art

Japanese Utility Model Publication No. 2546089 discloses a portable disc grinder in which a cylindrical motor housing for housing a motor is used as a grip to be held by a user. Grooves or projections are formed as a slip stopper on the outer surface of the grip in order to improve the gripping characteristics.

As for a cord-type disc grinder in which a motor is driven by power supplied via a power cord, it is known that a cylindrical rear cover for housing wiring parts to be used for connection between the power cord and the motor is provided on the rear end of the motor housing as a separate member from the motor housing.

In such a disc grinder in which the motor housing is used as a grip and the rear cover is provided on the rear side of the motor housing, however, the grip design is not satisfactory, and further improvement is required in this point.

SUMMARY OF THE INVENTION

It is, accordingly, an object of the invention to provide an effective technique for improving the gripping characteristics in a hand-held power tool.

The above-described problem can be solved by a claimed invention. The representative power tool according to the invention includes a motor that drives a tool bit, a cylindrical housing that houses the motor, and a cylindrical cover that is connected to one end of the housing in its longitudinal direction and houses motor actuating parts. The "power tool" in this invention typically represents an electric disc grinder which performs a grinding or polishing operation on a workpiece. The power tool however widely includes an electric grinding or polishing tool, such as a sander or a polisher, and an angle drill to be used for screw tightening operation, a jigsaw to be used for cutting operation and other similar electric power tools, and also includes a pneumatic power tool in which a tool bit is driven by an air motor. Further, preferably, the "cylindrical cover" in this invention can be removably attached to the housing for maintenance of the parts housed therein. Further, preferably, the cylindrical cover has a cylindrical shape having substantially the same diameter as the housing and the outer surface of the cylindrical cover is connected substantially flush with the outer surface of the housing.

In a preferred aspect of the invention, the housing and the cylindrical cover form a grip to be held by a user, and a plurality of projections are formed on the outer surface of the grip in a circumferential direction of the grip and extend from the housing to the cylindrical cover in the longitudinal direction. Specifically, according to this invention, by provision of the nonslip projections extending from the housing to the cylindrical cover, not only the cylindrical housing but also the cylindrical cover connected to the housing is utilized to form the grip. With such a construction, a relatively wide region extending from the housing to the cylindrical cover can be used as the grip, and in operation, the grip can be held by both hands as necessary. Particularly, the cylindrical cover side or the rear side of the grip can be made harder to slip like the housing side of the grip, so that the gripping characteristics can be improved. As a result, the gripping characteristics of the entire grip can be improved.

Further, the manner in which the projections "extend in the longitudinal direction" suitably includes not only the manner in which they extend linearly in the longitudinal direction of the grip, but the manner in which they extend obliquely (helically) with respect to the longitudinal direction of the grip, and also suitably includes both of the manner in which they extend continuously and the manner in which they extend discontinuously. Further, from the viewpoint of improvement of the gripping characteristics of the grip, the spacing between the projections is preferably set within the range of 3 to 8 mm.

According to a further aspect of the present invention, all or part of the protrusions can be defined by a mark protruding from the outer surface of the grip. The mark can be the sole protrusions or the mark can be a part of the protrusions. The mark may widely include any marks represented by letters, logo, trademarks, characters, figures, symbols or three-dimensional designs. Because the mark protrudes from the outer surface of the grip, the mark can be rationally utilized as a slip stopper of the grip.

According to a further aspect of the present invention, each of the projections has a generally triangular section in the longitudinal direction of the grip. In a horizontal position of the power tool in which the longitudinal direction of the grip coincides with the horizontal direction, the projections located in an upper region above a longitudinal center line of the grip have the triangular shape having an inclined surface on the upper surface side extending from a base to a top and an inclined surface on the lower surface side shorter than the upper inclined surface, while the projections located in a lower region below the longitudinal center line have the triangular shape having an inclined surface on the lower surface side extending from a base to a top and an inclined surface on the upper surface side shorter than the lower inclined surface.

When a user grips the grip in the horizontal position of the power tool in which the longitudinal direction of the grip coincides with the horizontal direction, typically, the grip is held with the palm of the hand generally on the upper surface of the grip and with the fingertips on the lower surface of the grip. On that premise, in this invention, the projections located in an upper region above a longitudinal center line of the housing have the triangular shape having an inclined surface on the upper surface side extending from the outer surface of the grip to a top and an inclined surface on the lower surface side shorter than the upper inclined surface, while the projections located in a lower region below the longitudinal center line have the triangular shape having an inclined surface on the lower surface side extending from the outer surface of the grip to a top and an inclined surface on the upper surface side shorter than the lower inclined surface. With this configuration, when the grip is held, the palm and the fingers of the hand can be appropriately and easily set on the grip without a feeling of being caught on the projections in the gripping direction. Thus, the grip is easy to grip. Further, in the state in which the grip is held in the hand, the fingers get caught on the tips of the projections, so that a hard-to-slip grip can be ensured. Specifically, the fingers do not get caught on the projections at the beginning of gripping, and once it is securely held in the hand, the fingers get caught on the projections. As a result, the grip with the projections can be provided with improved, easy-to-grip and hard-to-slip gripping characteristics.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
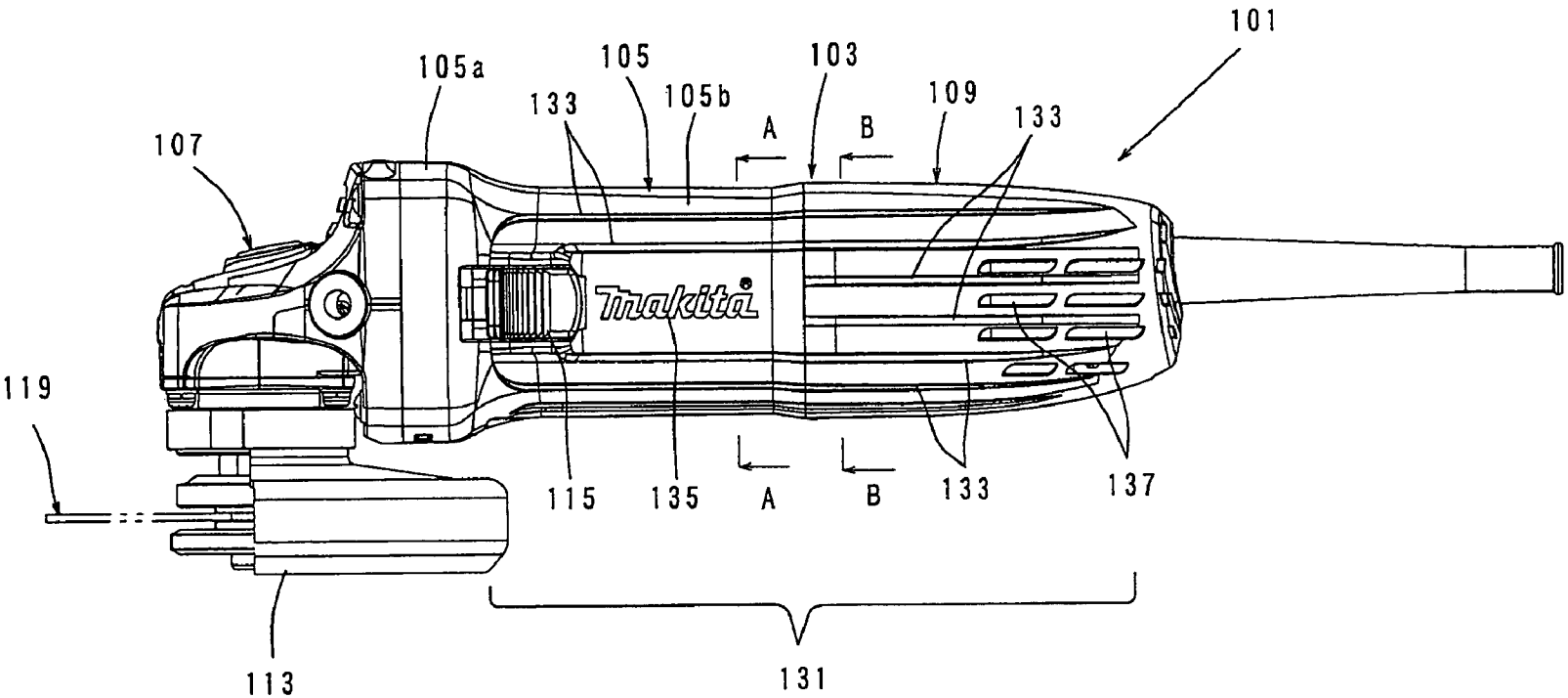
FIG. 1 is an external view showing the entire structure of an electric disc grinder according to an embodiment of the invention.
Figure 2:
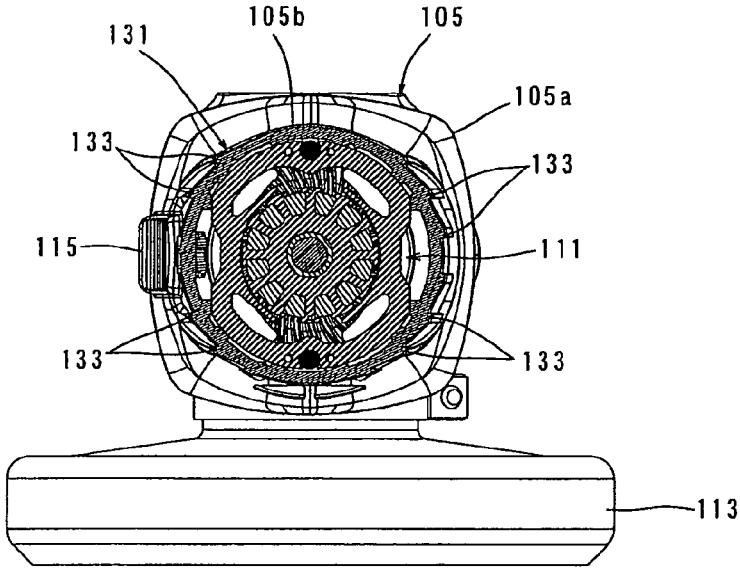
FIG. 2 is a sectional view taken along line A-A of FIG. 1.
Figure 3:
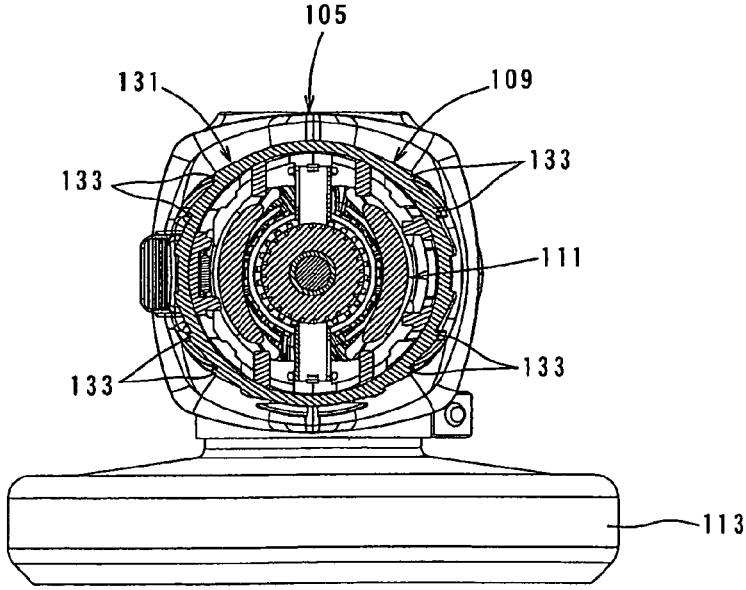
FIG. 3 is a sectional view taken along line B-B of FIG. 1.
Figure 4:
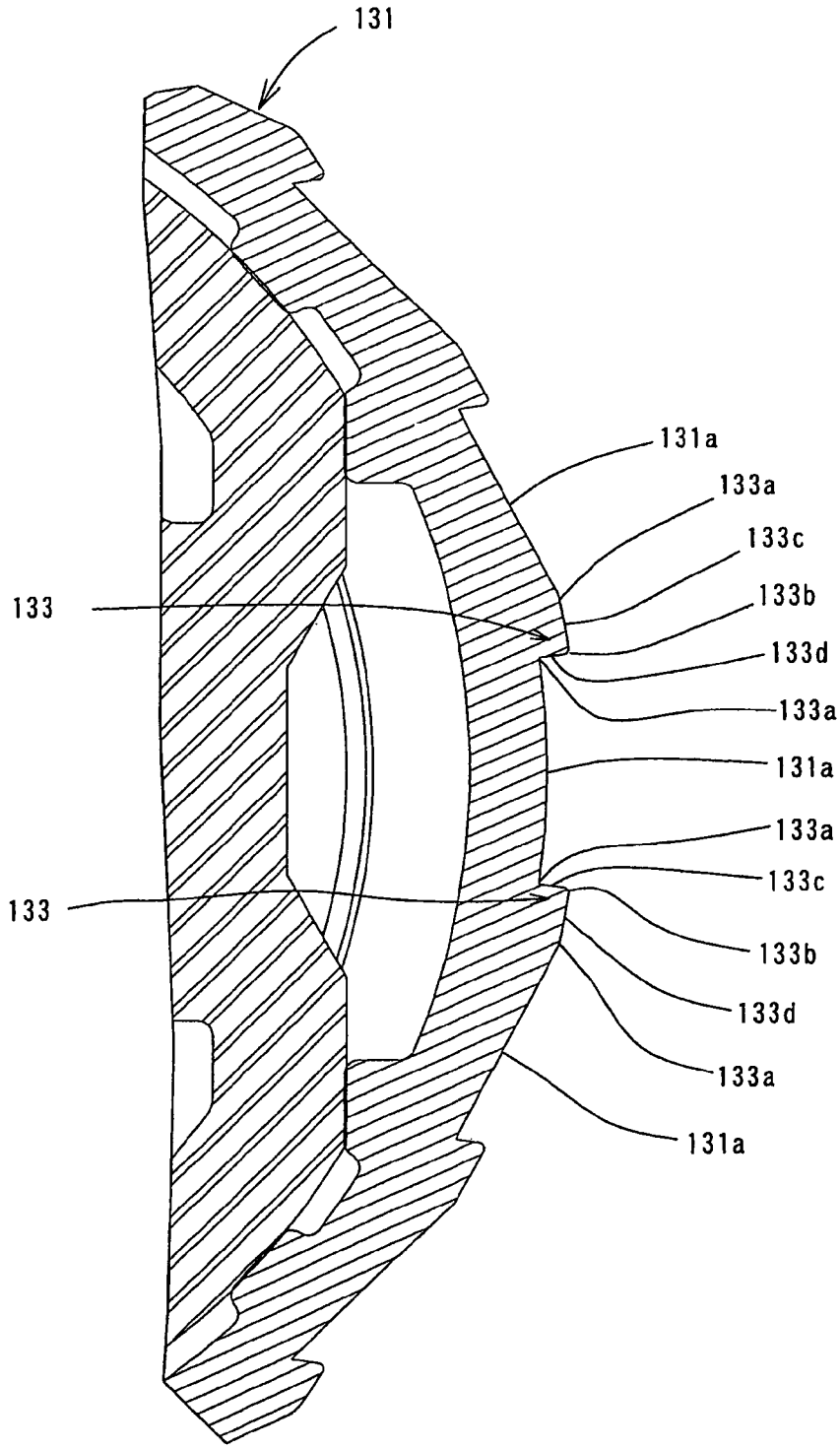
FIG. 4 is an enlarged sectional view showing the configuration of a rib.

An embodiment of the present invention is now described with reference to the drawings. In this embodiment, an electric disc grinder is explained as a representative example of a power tool according to the present invention. FIG. 1 is an external view showing the entire structure of an electric disc grinder 101 according to this embodiment. FIG. 2 is a sectional view taken along line A-A of FIG. 1, and FIG. 3 is a sectional view taken along line B-B of FIG. 1. FIG. 4 is an enlarged sectional view showing the configuration of a rib.

As shown in FIG. 1, the electric disc grinder 101 includes a body 103 that forms an outer shell of the electric disc grinder 101, and a grinding wheel 119 arranged in the tip end region of the body 103. The body 103 mainly includes a motor housing 105, a gear housing 107 connected to one end of the motor housing 105, and a rear cover 109 connected to the other end of the motor housing 105. The motor housing 105, the rear cover 109, and the grinding wheel 119 are features that correspond to the "housing", the "cylindrical cover" and the "tool bit", respectively, according to this invention. For the sake of convenience of explanation, the side of the grinding wheel 119 is taken as the front side and the opposite side as the rear side in the longitudinal direction of the body 103.

The motor housing 105 has a hollow tubular shape including a generally square housing part 105*a* formed on the front end side, and a generally circular cylindrical housing part 105*b* formed on the rear side of the square housing part 105*a* and smaller than the square housing part 105*a*. The front end of the square housing part 105*a* and the rear end of the cylindrical housing part 105*b* are open. Thus, the both ends of the motor housing 105 in the longitudinal direction are open. A driving motor 111 (see FIG. 2) is housed in the internal space of the cylindrical housing part 105*b*. The driving motor 111 is a feature that corresponds to the "motor" according to this invention. The driving motor 111 is arranged such that its axis of rotation extends in the longitudinal direction of the electric disc grinder 101 or in the longitudinal direction of the body 103.

As shown in FIG. 1, the gear housing 107 is connected to the square housing part 105*a* on the front end side of the motor housing 105. The gear housing 107 houses a power transmitting mechanism (not shown) for transmitting the rotating output of the driving motor 111 to the disc-like grinding wheel 119. Substantially a rear half of the grinding wheel 119 is covered by a grinding wheel cover 143. The rotating output of the driving motor 111 is transmitted to the grinding wheel 119 as rotation in the circumferential direction via the power transmitting mechanism. The grinding wheel 119 is arranged on one end side (front side) of the motor housing 105 in the longitudinal direction such that its axis of rotation is perpendicular to the axis of rotation of the driving motor 111.

Further, the hollow rear cover 109 having an open front end is connected to the rear end of the cylindrical housing part 105*b* on the rear end side of the motor housing 105. The electric disc grinder 101 according to this embodiment is of a cord type in which the driving motor 111 is driven by electric power which is supplied via a power cord connected to a power source (receptacle). Electrical parts and wiring parts, such as a plurality of brushes, brush holders and wiring, are arranged on the rear end side of the motor housing 105 and used to supply power to the driving motor 111. These electrical parts and wiring parts correspond to the "motor actuating parts" according to this invention and are housed in the rear cover 109. The electrical parts and wiring parts are maintained periodically or as necessary. In order to facilitate this maintenance, the rear cover 109 is removably attached to the motor housing 105. Vent holes 137 are formed between the ribs 133 in the side walls of the rear cover 109 such that outside air is taken in through the vent holes 137 for cooling the motor.

As shown in FIG. 1, a switch knob 115 is provided on the front side of the cylindrical housing part 105*b* of the motor housing 105 and operated to actuate a power switch for the driving motor 111. Therefore, by operating the switch knob 115 to drive the driving motor 111 while holding the cylindrical housing part 105*b* of the motor housing 105, the user can rotationally drive the grinding wheel 119 via the power transmitting mechanism and appropriately perform a grinding or polishing operation or a cutting operation on a workpiece.

In this embodiment, the cylindrical housing part 105*b* of the motor housing 105 and the rear cover 109 form a grip 131 which is held by one or both hands of the user. The grip 131 is a feature that corresponds to the "grip" according to this invention. In order to form the grip 131, the rear cover 109 has the same generally cylindrical shape as the cylindrical housing part 105*b* of the motor housing 105 (see FIG. 3), and the outer surface of the rear cover is connected substantially flush with the outer surface of the cylindrical housing part 105*b* of the motor housing 105 (see FIG. 1). The grip 131 is long enough in the longitudinal direction to be held with both hands set one behind the other in the longitudinal direction. Further, the grip 131 has such a thickness that a space of about 1 cm (centimeter) is created between a fingertip of the thumb and a fingertip of the index finger of the hand holding the grip 131.

A plurality of nonslip ribs 133 are provided in the outer surface of the grip 131 formed by the cylindrical housing part 105*b* of the motor housing 105 and the cylindrical rear cover 109. The ribs 133 extend in the longitudinal direction of the grip 131 or in longitudinal direction of the body 103 and are spaced generally equidistantly in the circumferential direction of the grip 131. The ribs 133 are features that correspond to the "projections" according to this invention. The ribs 133 extend continuously from the cylindrical housing part 105*b* of the motor housing 105 to the rear cover 109. In this embodiment, the ribs 133 are provided in the regions of the side and lower surfaces of the grip 131, or regions of the grip 131 other than the upper surface region.

In terms of the gripping characteristics, it is important for the grip 131 to be easy to grip and hard to slip. From this viewpoint, in this embodiment, the spacing between the ribs 133 arranged in the circumferential direction of the grip 131 is set within a range from such an extent (A) that the fingertips of the user holding the grip 131 are kept in contact with the grip surface of the grip 131 to such an extent (B) that the fingertips certainly get caught on the ribs 133. Experimental results show that the spacing (A) is approximately 3 mm (millimeter) or more and the spacing B is approximately 8 mm (millimeter) or less. Specifically, in this embodiment, the spacing between the ribs 133 is set within the range of 3 to 8 mm, so that the easy-to-grip and hard-to-slip grip 131 can be obtained. Further, the height of the ribs 133 is set to 0.1 mm at the minimum.

Further, in this embodiment, the upper surface region of the grip 131 which the user touches by a large part of the palm of the hand when holding the grip 131 has none of the ribs 133. Specifically, the upper surface region of the grip 131 has a smooth circular-arc outer surface, which provides a nice and soft feel to the palm of the user's hand.

Further, as shown in FIGS. 2 to 4, each of the ribs 133 formed on the outer surface of the grip 133 has a generally triangular section in the longitudinal direction of the housing. As particularly clearly seen from FIG. 4, in the horizontal position of the disc grinder 101 in which its longitudinal direction coincides with the horizontal direction, the ribs 133 located in the upper region above the longitudinal center line of the body 103 have an angle section of a sawtooth shape of which bisector of the interior angle of the top extends generally obliquely downward, while the ribs 133 located in the lower region below the longitudinal center line of the body 103 have an angle section of a sawtooth shape of which bisector of the interior angle of the top extends generally obliquely upward. Specifically, each of the upper ribs 133 has an inclined surface 133*c* on the upper surface side extending from a base 133*a* or a junction between the rib and an outer surface 131*a* of the grip 131 to a top 133*b*, and an inclined surface 133*d* on the lower surface side shorter than the upper inclined surface 133*c*. On the other hand, each of the lower ribs 133 has an inclined surface 133*d* on the lower surface side extending from a base 133*a* to a top 133*b*, and an inclined surface 133*c* on the upper surface side shorter than the lower inclined surface 133*d*.

Further, in this embodiment, as shown in FIG. 1, a logo 135 is provided on the side region of the cylindrical housing part 105*b* of the motor housing 105. The logo 135 is corresponding to one type of "mark" according to the invention and is formed (indicated) by a protrusion protruding from the side of the cylindrical housing part 105*b*. The logo 135 is arranged in a position to be touched, for example, by the tip of the user's thumb if the user holds the grip 131 by the right hand. Thus, the logo 135 serves as a slip stopper for the thumb.

The disc grinder 101 according to this embodiment is constructed as described above. When the user operates the switch knob 115 to drive the driving motor 111, the grinding wheel 119 rotates. Then by pressing the grinding wheel 119 against a workpiece, the user can perform a predetermined operation, such as grinding and polishing, on the workpiece.

During the above operation, according to this embodiment, the user operates the disc grinder 101 while holding the grip 131 which is formed by the cylindrical housing part 105*b* of the motor housing 105 and the rear cover 109, by one or both hands. In this embodiment, by provision of the nonslip ribs 133 extending from the cylindrical housing part 105*b* of the motor housing 105 to the rear cover 109, not only the motor housing 105 but also the rear cover 109 connected to the motor housing 105 is utilized to form the grip 131. Therefore, particularly, the rear cover 109 can be made harder to slip like the motor housing 105, so that the gripping characteristics of the rear cover 109 is improved. As a result, the gripping characteristics of the entire grip 131 can be improved.

Further, the grip 131 is long enough to be held by both hands. Therefore, when the grip 131 is held by both hands, the same level of gripping characteristics can be ensured for both of the hands, so that stable gripping can be realized. Further, when the grip 131 is held by one hand, the position of the hand to hold the grip 131 can be appropriately changed in the longitudinal direction of the grip, so that the usability can be enhanced. Further, the ribs 133 extend in the longitudinal direction of the grip 131 and arranged at predetermined intervals in the circumferential direction. Therefore, particularly, the gripping characteristics can be improved in the circumferential direction of the grip 131.

Typically, the grip 131 is held by a user with the palm of the hand generally on the upper surface of the grip 131 and with the fingertips on the lower surface of the grip 131. Therefore, the palm and the base side of the fingers of the user's hand are set on the outer surface of the grip 131 in such a manner as to cover the grip 131 from above, and the fingertip side of the hand is set on the outer surface of the grip 131 in such a manner as to hold the grip 131 from below. In this embodiment, the ribs 133 on the upper side above the longitudinal center line have an angle section of a generally sawtooth shape of which bisector of the interior angle of the top 133*b* extends generally obliquely downward, while the ribs 133 on the lower side have an angle section of a generally sawtooth shape of which bisector of the interior angle of the top 133*b* extends generally obliquely upward. Specifically, the ribs 133 protrude along the directions in which the palm and the fingers are set to hold the grip 131. Further, the ribs 133 protrude in the directions in which the palm and the fingers get caught on the ribs 133 once the grip 131 is securely held in the hand. Thus, the grip 131 can be held with lower resistance and can be harder to slip when held by the hand.

Further, in this embodiment, the logo 135 is formed by a protrusion and serves as a slip stopper of the grip 131. Thus, the logo 135 rationally has two functions.

Further, although, in this embodiment, the ribs 133 of the grip 131 extend continuously in the longitudinal direction of the body 103, they may extend discontinuously. Further, the ribs 133, which are spaced equidistantly in the circumferential direction of the grip 131 in this embodiment, may be spaced otherwise. Further, the ribs 133, which extend linearly along the longitudinal direction of the grip 131 in this embodiment, may extend obliquely (helically) with respect to the longitudinal direction of the grip 131. Further, the ribs 133, which have a generally triangular section in this embodiment, may have a generally semicircular or rectangular section.

Further, in this embodiment, the electric disc grinder was described as a representative example of the power tool. However, the present invention can also be applied to any other power tool which has a motor housing to be used as a grip and also has a cover member that is provided on the rear side of the motor housing in order to house parts for supplying power to the driving motor. Further, the present invention can be applied not only to an electric power tool, but also to a pneumatic power tool in which the tool bit is driven by an air motor.

DESCRIPTION OF NUMERALS

101 electric disc grinder (power tool)
103 body
105 motor housing (housing)
105*a* square housing part
105*b* cylindrical housing part
107 gear housing
109 rear cover (cylindrical cover)
111 driving motor (motor)
113 grinding wheel cover
115 switch knob
119 grinding wheel (tool bit)
131 grip
131*a* outer surface
133 rib (projection)
133*a* base
133*b* top
133*c* upper inclined surface
133*d* lower inclined surface
135 logo
137 vent hole

What we claim is:

1. A power tool comprising:
a motor that drives a tool bit,
a cylindrical housing that houses the motor,
a motor actuating parts that actuates the motor,
a cylindrical cover that is connected to one end of the housing in its longitudinal direction and houses the motor actuating parts,
a grip to be held by a user of the power tool, the grip being defined by the housing and the cylindrical cover, and
a plurality of projections formed on the outer surface of the grip, wherein each projection extends between the housing and the cover in the longitudinal direction of the power tool, each projection including an inclined surface extending circumferentially outwardly from the outer surface of the grip, the inclined surface converging with the outer surface to define a notch.

2. The power tool as defined in claim 1, wherein all or part of projections are defined by a mark protruding from the outer surface of the grip.

3. The power tool as defined in claim 2, wherein the mark is provided on an outer side region of the grip.

4. The power tool as defined in claim 1, wherein each of the projections has a generally triangular cross section viewed in the longitudinal direction of the grip, and in a horizontal position of the power tool in which the longitudinal direction of the housing coincides with the horizontal direction, the projections located in an upper region above a longitudinal center line of the grip have the triangular shape having an inclined surface on the upper surface side extending from a base to a top and an inclined surface on the lower surface side shorter than the upper inclined surface, while the projections located in a lower region below the longitudinal center line of the grip have the triangular shape having an inclined surface on the lower surface side extending from a base to a top and an inclined surface on the upper surface side shorter than the lower inclined surface.

5. The power tool as defined in claim 1, wherein the spacing between each projection is set within the range of 3 mm (millimeter) to 8 mm (millimeter).

6. The power tool as defined in claim 1, wherein the height of each projection is set to 0.1 mm (millimeter) at the minimum.

7. The power tool as defined in claim 1, wherein the projections are provided on an outer surface other than the top surface of the grip.

8. The power tool as defined in claim 1, wherein the plurality of projections are formed on the outer surface of the grip in an upper region above a longitudinal center line of the grip and in a lower region below the longitudinal center line of the grip, and the projections in the upper region define notches that are angled generally obliquely downward and the projections in the lower region define notches that are angled generally obliquely upward.

* * * * *